US006237796B1

(12) United States Patent
Murphy, Jr.

(10) Patent No.: US 6,237,796 B1
(45) Date of Patent: May 29, 2001

(54) COMBINATION CHEMICAL CARRIER AND BUCKET DEVICE

(76) Inventor: Erle N. Murphy, Jr., 16738 Terrey Pine Dr., Eden Prairie, MN (US) 55347

( * ) Notice: Subject to any disclaimer, the term of this patent is extended or adjusted under 35 U.S.C. 154(b) by 0 days.

(21) Appl. No.: 09/580,796

(22) Filed: May 30, 2000

(51) Int. Cl.[7] ..... B65D 21/02

(52) U.S. Cl. ..... 220/4.03; 220/23.4; 220/509; 206/408

(58) Field of Search ..... 220/4.03, 23.4, 220/23.8, 23.86, 23.83, 508, 509; 206/408, 397

(56) References Cited

U.S. PATENT DOCUMENTS

Re. 19,075 * 2/1934 Faust ..... 206/408
1,456,401 * 5/1923 Powell ..... 206/408
3,195,721 * 7/1965 Weckesser ..... 206/397
4,470,509 * 9/1984 Wischoff ..... 206/408
5,139,299 * 8/1992 Smith ..... 220/23.4
5,287,964 * 2/1994 Jacquand et al. ..... 206/408
5,339,976 * 8/1994 Thornton ..... 220/23.4
5,868,246 * 2/1999 Wesfall et al. ..... 220/23.4

* cited by examiner

*Primary Examiner*—Joseph M. Moy
(74) *Attorney, Agent, or Firm*—Herman H. Bains

(57) ABSTRACT

A combination chemical carrier device and bucket includes a compartmented chemical carrier for carrying a plurality of containers containing chemicals and products used in cleaning operations. The combination chemical carrier and bucket device also includes a bucket for containing liquids including chemical solutions used in cleaning operations. The bucket and chemical carrier are provided with quick coupling for readily connecting and disconnecting the chemical and bucket.

5 Claims, 3 Drawing Sheets

COMBINATION CHEMICAL CARRIER AND BUCKET DEVICE

FIELD OF THE INVENTION

This invention relates to cleaning equipment and more particularly to a combination chemical carrier and bucket for use in domestic and institutional cleaning.

BACKGROUND OF THE INVENTION

In both domestic and institutional cleaning operations, various commercial chemical products are used to clean surfaces, mirrors, countertops, toilet bowls, toilet chests, urinals, furniture, appliances, and other structures. The chemicals used in the cleaning operation are sometimes dissolved in water or diluted with water. Therefore a user needs a supply of the various chemical cleaners and containers for water.

SUMMARY OF THE INVENTION

An object of this invention is to provide a novel chemical carrier and bucket which are secured together to form a unit for ease in carrying from one location to another, but the bucket and carrier being readily detachable for ease in use.

In the preferred embodiment, the chemical carrier is of open top, compartmented configuration for accommodating a plurality of chemical products used in cleaning operations. The bucket and chemical carrier are secured together by quick coupling connections which allow readily connection and disconnection of the bucket and carrier. The bucket and chemical carrier are of simple and inexpensive construction thereby assuring economy of production.

DESCRIPTION OF THE PREFERRED EMBODIMENT

Figure 2:
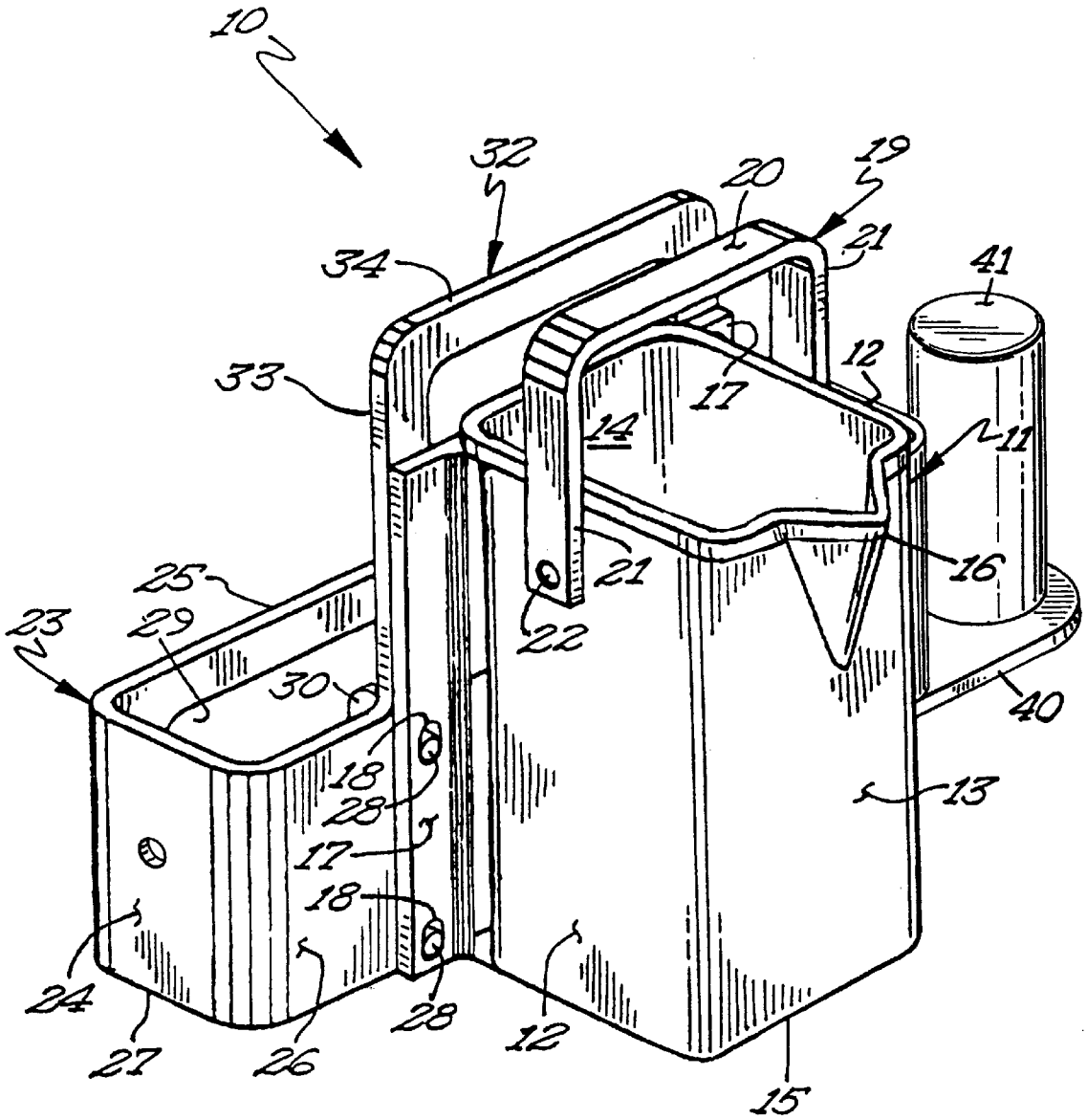
FIG. 2 is a rear perspective view of the chemical carrier and bucket in the assembled condition.

Referring now to the drawings, it will be seen that one embodiment of the chemical carrier and bucket device, designated generally by the reference numeral 10, is there-shown. The chemical device and bucket device 10 includes an open top bucket 10 and an open top chemical carrier 23 each being formed of a rigid material, preferably a rigid plastic material. The bucket 11, in the embodiment shown, is of generally rectangular configuration but could have other shapes such as cylindrical, oval, frusto conical or similar configurations. The bucket has opposed side walls 12, a front wall 13, a rear wall 14, and a bottom wall 15. The bucket 11 also has a pouring spout 16 formed in the front wall at the upper edge portion thereof. The rear wall 14 has a pair of substantially flat flanges 17 projecting laterally outwardly from opposite vertical edges thereof. Each flange 17 has a pair of vertically spaced apart keyhole openings 18 therein as best seen in FIG. 2.

Figure 1:
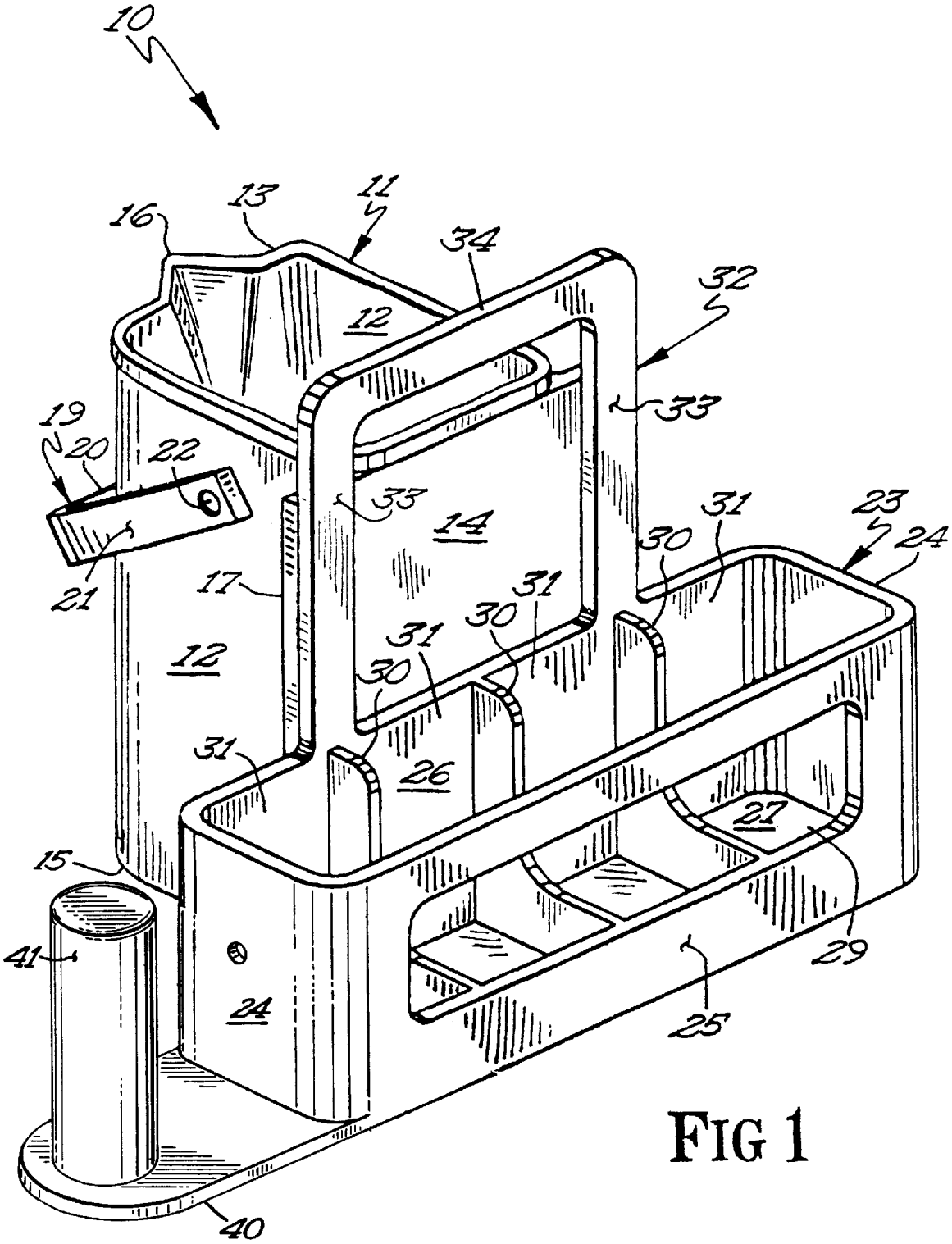
FIG. 1 is a front perspective view of the chemical carrier and bucket in the attached assembled condition.

The bucket 11 is also provided with a U-shaped handle 19 including a pair of arms 21 and a bight portion 20. The arms 21 are pivotally connected to the side walls 12 by pivots 22. The handle 19 is pivotal between an upright carrying position (FIG. 2) and an out-of-the-way position (FIG. 1).

The chemical carrier 23 is of elongate rectangular configuration and includes opposed, substantially parallel side walls 24, a front wall 25, a rear wall 26 and a bottom wall 27. The rear wall 26 has a plurality of headed studs 28 secured thereto and extending therefrom. The studs 28 are located inwardly of the side walls 24. In the embodiment shown, four such studs are provided and are disposed in laterally spaced apart, vertically arranged pairs. The headed studs 28 of each pair are located adjacent the upper and lower edges of the rear wall 26.

The headed studs 28 are insertable into the keyhole openings 18 in the flanges 17. The keyhole openings 18 and the headed studs 28 constitute quick coupling means for readily attaching and detaching the bucket 11 and chemical carrier 23.

It will be noted that the front wall 25 has an elongate, generally rectangular opening 29 therein to permit a user to readily read the labels on the chemical containers positioned within the carrier. Easy identification of the chemicals facilitate ease and efficiency in the cleaning operation.

The chemical carrier 23 is provided with a U-shaped handle 32 which includes a pair of legs 33 interconnected by a bight portion 34. The legs 33 of the handle are rigidly connected to the upper edge of the rear wall 26 of the carrier 23. A plurality of vertically disposed, similar L-shaped divider walls 30 extend between and are secured to the front and rear walls of the chemical carrier. The walls 30 are disposed in parallel relation to each other and divide the interior of the chemical carrier into a plurality of compartments. Each compartment accommodates one or more containers containing chemical cleaners or other necessary products. It is pointed out that the divider walls 30 could be of rectangular configuration extending the full vertical dimension of the front wall 25.

In use, the combination chemical carrier and bucket will be secured together to facilitate carrying of the device to a particular location. The chemical carrier will contain various chemical cleaners and other products used in the cleaning operation. If a chemical to be used must be dissolved in water, the user will detach the carrier and bucket, and the bucket will be filled with the correct amount of water. The aqueous solution will be prepared and the various cleaning tasks will be performed. When the cleaning tasks at a particular location are completed, the user will reattach the carrier and bucket for ease in carrying the device to the next location. In the embodiment shown, the capacity of the bucket is two (2 ) gallons. The number of compartments of the carrier may vary depending on the cleaning operation. The transverse or width dimension of the chemical is greater than the width dimension of the bucket, and the vertical dimension of the bucket is greater than the vertical dimension of the carrier.

It will be noted that the bottom wall 27 projects outwardly beyond the adjacent side wall 24 from one end of the chemical carrier 23 to define an extension 40. The extension 40 has an upstanding post 41 secured thereto and extending upwardly therefrom. The extension 40 and post 41 serve to support a roll of towels which are routinely used in cleaning operations.

Figure 3:
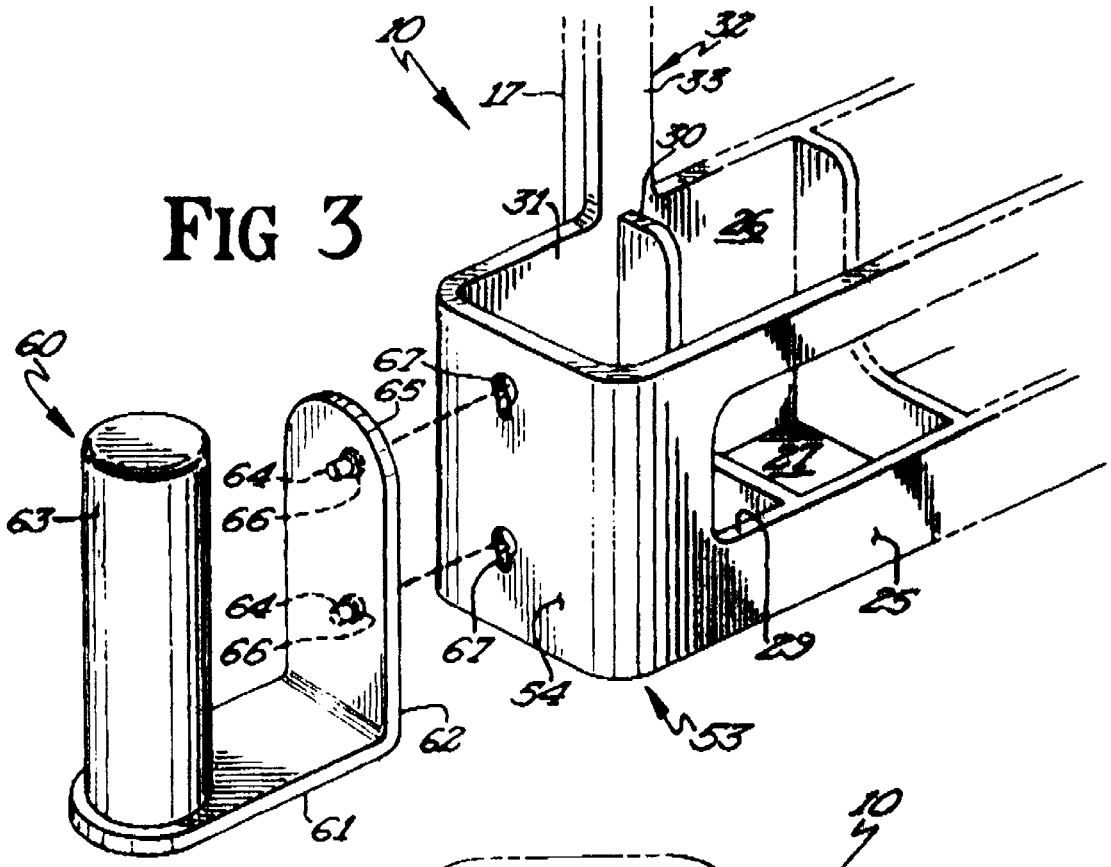
FIG. 3 is a fragmentary exploded perspective view of a portion of the chemical carrier illustrating a detachable towel roll support.
Figure 4:
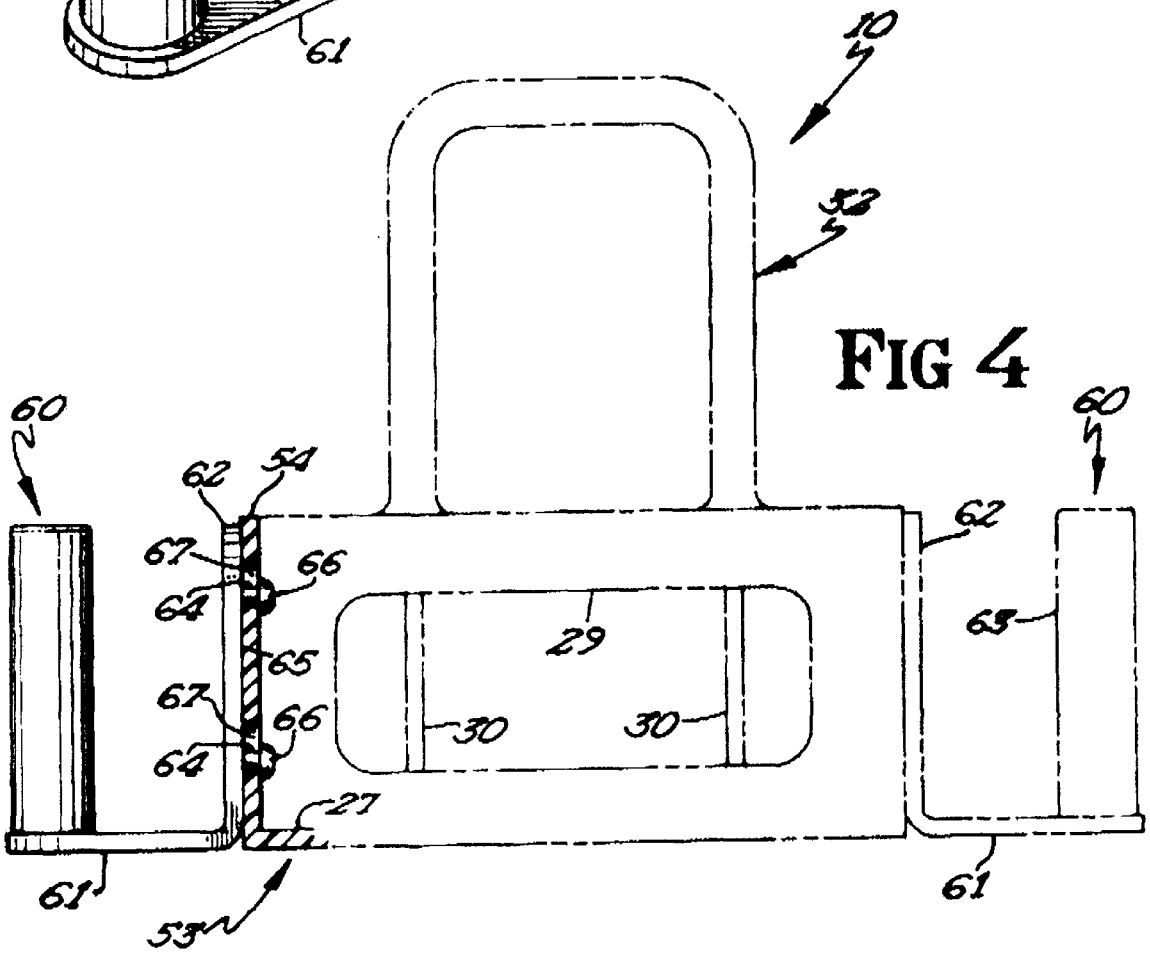
FIG. 4 is a part elevational view and part sectional view of the detachable towel roll support and an end portion of the carrier, the remainder of the carrier illustrated in phantom line configuration.

Referring now to FIGS. 3 & 4, it will be seen that a different embodiment of the chemical carrier 53 is there-shown. The chemical carrier 53 is similar to the embodiment of FIGS. 1 & 2 but differs in the construction of the towel roll support. In the embodiment of FIGS. 1 & 2, the towel roll support is integral with the chemical carrier. However, the towel roll support 60 in the embodiment of FIGS. 3 & 4 is detachable from the chemical carrier 53.

The towel roll support 60 is of L-shaped construction and includes a horizontal support member 61 and a vertical attachment member 62 integral with the horizontal support member. The horizontal support member 61 has a vertical post 63 secured thereto and projecting upwardly therefrom. The post 63 accommodates a roll of towels to be dispensed.

The attachment member 62 has a pair of vertically spaced apart studs 64 and projecting outwardly of the outer surface 65 of the attachment member 62. Each stud 64 is provided with a head 66. Both side walls 54 are provided with vertically spaced apart keyhole openings 67 therein. The studs on the vertical attachment member 62 may be inserted into the keyhole openings 67 to readily attach the towel roll support to an end wall 54. Since the towel roll support 60 may be selectively attached to a side wall of the chemical carrier to accommodate a left handed or right handed user.

From the foregoing description, it will be seen that I have provided a novel combination bucket and chemical carrier device having a towel roll support which may be detached and reattached to the chemical carrier for readily shifting the towel roll support from one side of the chemical carrier to the other side thereof.

What is claimed is:

1. A combination chemical carrier and bucket device comprising, an open top bucket for containing liquids and including a bottom wall portion, opposed side wall portions, opposed front and rear wall portions, a handle secured to the bucket, a pair of flanges secured to the rear wall and projecting laterally outwardly from opposite edge portions thereof, an open top compartmented chemical carrier having opposed side walls, opposed front and rear walls, and a bottom wall, a plurality of substantially flat, spaced apart, parallel vertical walls extending between and secured to the front and rear walls to form a plurality of compartments for holding containers containing chemicals and products for cleaning, quick coupling means on the rear wall of the compartmented carrier and said flanges for positively securing said carrier and bucket together in abutting wall-to-wall relation to permit carrying the combination chemical carrier and bucket device from one location to another, and permitting ready disconnection of the bucket and chemical carrier for use in cleaning, and a towel roll support having a vertical towel roll post thereon for supporting a roll of paper towels, and means on said towel roll support and the side walls of the chemical carrier for selectively attaching the towel roll support to one of the side walls of the chemical carrier.

2. The combination chemical carrier and bucket device as defined in claim 1 wherein said attachment means comprises keyhole openings and headed studs.

3. The combination chemical carrier and bucket as defined in claim 2 wherein the keyhole openings are in said side walls of the chemical carrier and the headed studs are on the towel roll support.

4. The combination chemical carrier and bucket as defined in claim 1 wherein the chemical carrier has a width dimension greater than said bucket, and said bucket having a vertical dimension greater than said chemical carrier.

5. The combination chemical carrier and bucket as defined in claim 1 wherein said towel roll support is of L-shaped configuration including a horizontal support portion and a vertical attachment portion integral with said horizontal support portion, said towel roll post being attached to said horizontal portion.

* * * * *